US005088406A

United States Patent [19]

Clin

[11] Patent Number: 5,088,406

[45] Date of Patent: Feb. 18, 1992

[54] STRUCTURE OF AUTOMATIC STAMPING MACHINE

[76] Inventor: Cliang P. Clin, 4F., No 282 Section 2 Li Nung Street, Taipei, Taiwan

[21] Appl. No.: 647,409

[22] Filed: Jan. 29, 1991

[51] Int. Cl.[5] ..... B41F 1/44

[52] U.S. Cl. ..... 101/332; 101/103; 101/336

[58] Field of Search ..... 101/18, 103, 104, 107, 101/109, 327, 332, 333, 336, 389.1; 400/689

[56] References Cited

U.S. PATENT DOCUMENTS 2,356,951 8/1944 Rurnton ..... 101/336
2,370,416 2/1945 Polley ..... 101/336
3,878,782 4/1975 Coffelt ..... 101/336
4,063,500 12/1977 Abe ..... 101/336
4,387,641 6/1983 Kortick ..... 101/332

*Primary Examiner*—J. Reed Fisher
*Assistant Examiner*—Ren Yan
*Attorney, Agent, or Firm*—Bacon & Thomas

[57] ABSTRACT

An automatic stamping machine, comprising an electronic control system to control a driving mechanism to carry an automatic ribbon take-up mechanism and a noise deadening device to perform automatic stamping operation with operational noise simultaneously deadened.

1 Claim, 4 Drawing Sheets

STRUCTURE OF AUTOMATIC STAMPING MACHINE

BACKGROUND OF THE INVENTION

The present invention relates to automatic stamping machines, and more particularly to an automatic stamping machine which can deaden the noise, adjust the position of the paper rack, and automatically take up the ribbon (inked tape) during the operation of the machine.

According to the present invention, there is provided an automatic stamping machine having a driving arm controlled by a solenoid to carry a deadening device to deaden the noise, drive a ribbon take-up mechanism to take up an inked tape, and pull the paper rack to a suitable position for stamping.

DETAILED DESCRIPTION OF THE PREFERRED EMBODIMENT

Figure 1:
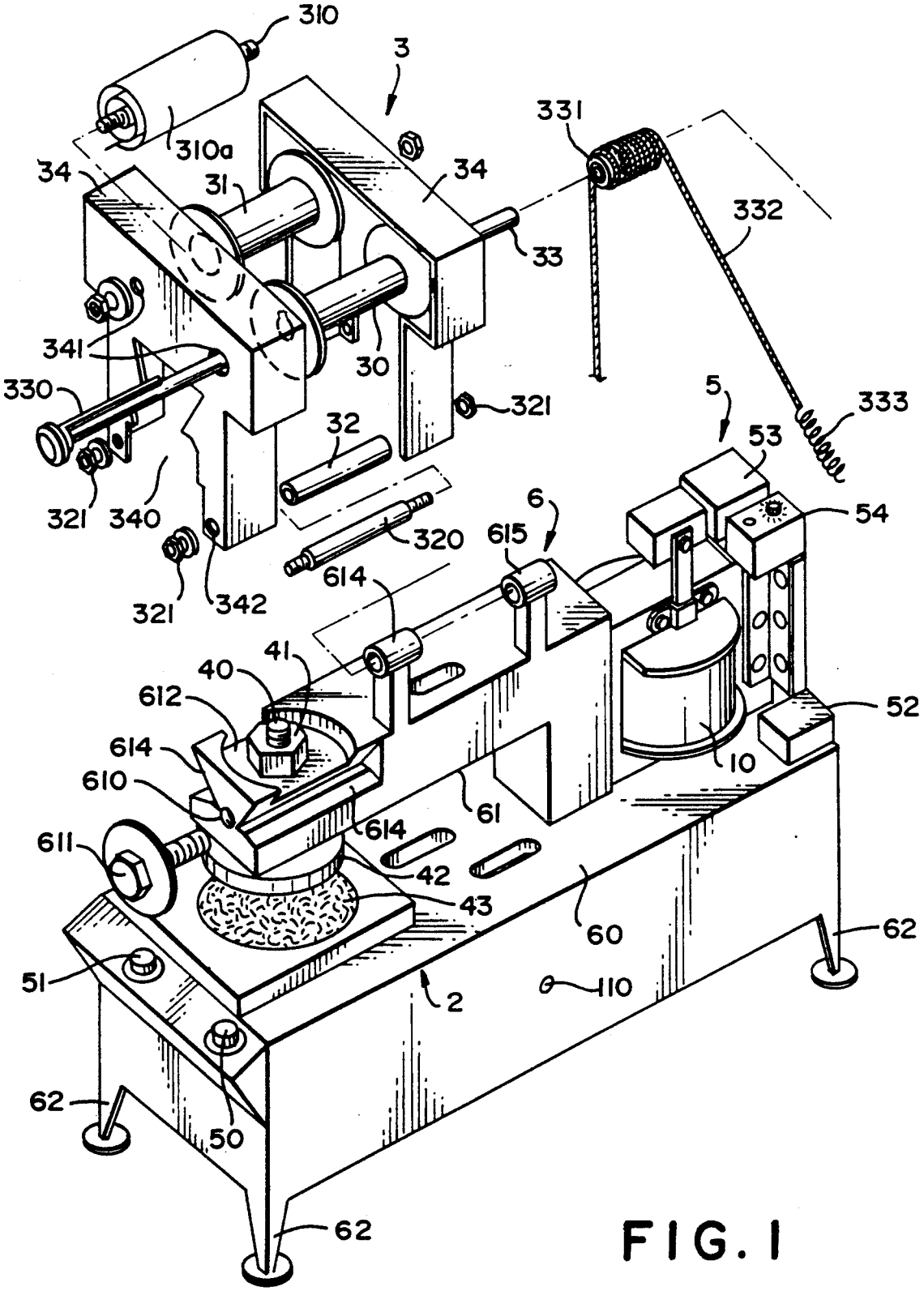
FIG. 1 is a perspective dismantled view of the preferred embodiment of the present invention.

Referring to FIG. 1, an automatic stamping machine in accordance with the present invention is generally comprised of a machine table 6 having mounted thereon a driving mechanism 1, a noise deadening device 2, an automatic ribbon (inked tape) take-up mechanism 3, a stamp mounting device 4 and an electronic control system 5. The machine table 6 is supported by four stands 62, having a substantially L-shaped support 61 made on a platform 60. The platform 60 has a cylinder 600, which has a blot sleeve **600*a* at the bottom center, disposed in a vertical position for holding the noise deadening device 2. A bolt hole 610 is made on the L-shaped support 61 at one side for mounting a fastening element 611 to secure a ribbon (inked tape) casing. The L-shaped support 61 further has a circular recess 612 at the top which has a round hole 613 at the center, and two dovetailed grooves 614 at two opposite locations and respectively inclining inwards. Through the circular recess 612 and the round hole 613, the stamp mounting device 4 can be fixedly secured to the L-shaped support 61 by a screw bolt 40 and a lock nut 41 and disposed right above the cylinder 600. The driving mechanism 1 is comprised of a solenoid 10 mounted on the platform 60 at the back side, and a rocker arm 11 pivoted to the platform 60 at the bottom through a pivot 110. The solenoid 10 is designed to move in one direction, and the rocker arm 11 has one end connected to the shaft 100 of the solenoid 10. When the starting switch 51 is pressed on, the shaft 100 of the solenoid 10 is attracted to move upward, causing the rocker arm 11 to rock. The rocker arm 11 has an elongated hole 111 at an opposite end for holding a T-shaped paper rack. There is alos provided a springing element 112 to confine the rocking motion of the rocker arm 11, of which the tensile strength is controlled by an adjusting screw a. The noise deadening device 2 is comprised of a T-shaped paper rack 20 mounted on a compression spring 21 and secured to the cylinder 600 at the top. The T-shaped paper rack 20 comprises a cylindrical body 202 having a top edge 200 made of flexible rubber and covered with a layer of rigid rubber 201, and a connecting rod 203 vertically extending downward from said top edge 200 at the center. During assembly, the cylindrical body 202 is inserted through the compression spring 21 and fastened in the cylinder 600, with the connecting rod 203 inserted through the bolt sleeve 600*a* of the cylinder 600 and the elongated hole 111 of the rocker arm 11 to fasten with a lock nut 304. Therefore, when the starting switch 51 is pressed on, the rocker arm 11 is carried by the shaft 100 of the solenoid 10 to rock, causing the noise deadening device 2 to move downward and simultaneously compress the compression spring 21. When power supply is cut from the solenoid 10, the T-shaped paper rack 20 is released from the pulling force of the rocker arm 11, and the compression spring 21 immediately forces the T-shaped paper rack 20 to move back to original upper position. At the same time, the springing element 112 pulls the rocker arm 11 to push the shaft 100 of the solenoid 10 back to original position. The automatic ribbon (inked tape) take-up mechanism 3 comprises a T-shaped ribbon casing 34 having mounted therein a ribbon take-up reel 30, a ribbon supply reel 31, two rollers 32 and a revolving shaft 33. The T-shaped ribbon casing 34 is comprised of two opposite; T-shaped shells, defining therein a opening 340 at the bottom for mounting the L-shaped support 61. The two opposite, T-shaped shells of the T-shaped ribbon casing 34 comprise each two pair of round holes 341 and 342, wherein the first pair of round holes 341 which are disposed at an upper position are provided for mounting the two reels 30 and 31, the second pair of round holes 342 which are disposed at a lower position are provided for mounting the two rollers 32. The rollers 32 are respectively secured between the two opposite, T-shaped shells of the T-shaped ribbon casing 34 by a screw rod 320 each which has two opposite ends respectively fastened in the second pair of round holes 342 and secured thereto by lock nuts 321. The ribbon take-up reel 30 is secured inside the T-shaped casing 34 between the round holes 341 at the front end by the revolving shaft 33 via a chain 330. The revolving shaft 33 is inserted through the T-shaped ribbon casing 34 and further supported by two bearings 614 and 615 with an one-way bearing 331 mounted thereon and disposed between said two bearings 614 and 615. There is provided a rope 332 winding on the one-way bearing 331 and having two opposite ends respectively fastened to the rocker arm 11 at two opposite sides relative to the pivot 110, wherein the end which is near the solenoid 10 is secured to the rocker arm 11 through an elastic element 333. When the shaft 110 of the solenoid 10 drives the rocker arm 11 to pull the T-shaped paper rack 20 to move downward, the rope 332 is simultaneously carried to rotate the one-way bearing 331, causing the revolving shaft 33 to rotate. During the rotary motion of the revolving shaft 33, the ribbon take-up reel 30 is rotated to take up the ribbon mounted thereon. The ribbon supply reel 31 is secured inside the T-shaped casing 34 between the round holes 341 at the back end by a screw rod 310 via an elastic element 310*a*. After assembled, the opening 340 of the T-shaped ribbon casing 34 of the ribbon (inked tape) take-up mechanism 3 is mounted on the front end of the L-shaped support and fixedly secured in place by a fastening element 611. The stamp mounting device 4 is comprised of an electromagnet 42 fastened in the L-shaped support 61 at the front bottom by a screw rod 40 and a lock nut 41 to attract a stamp 43** in place.

The electronic control system 5 is comprised of a main switch 50, a starting switch 51, an AC/DC converter 52, a relay 53 and a timer 54. The main switch 50 controls the power supply and the positioning of the stamp 43 in the electromagnet 42. The starting switch 51 turns on the AC/DC converter 52, the relay 53 and the timer 54 to control driving mechanism 1 to operate. Through the operation of the driving mechanism 1, the noise deadening device 2 and the automatic ribbon take-up mechanism 3 are driven to operate properly.

Figure 2:
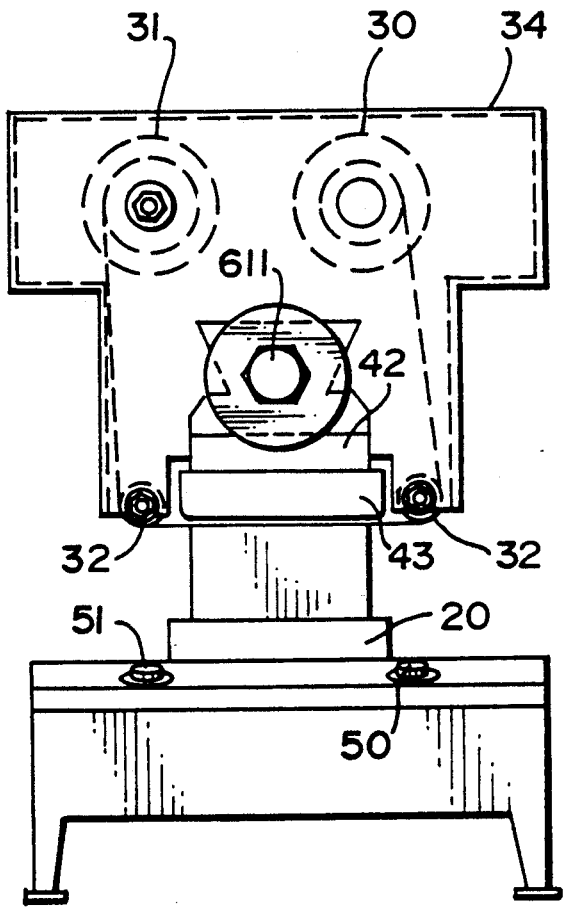
FIG. 2 is a front view of the preferred embodiment of the present invention.
Figure 3:
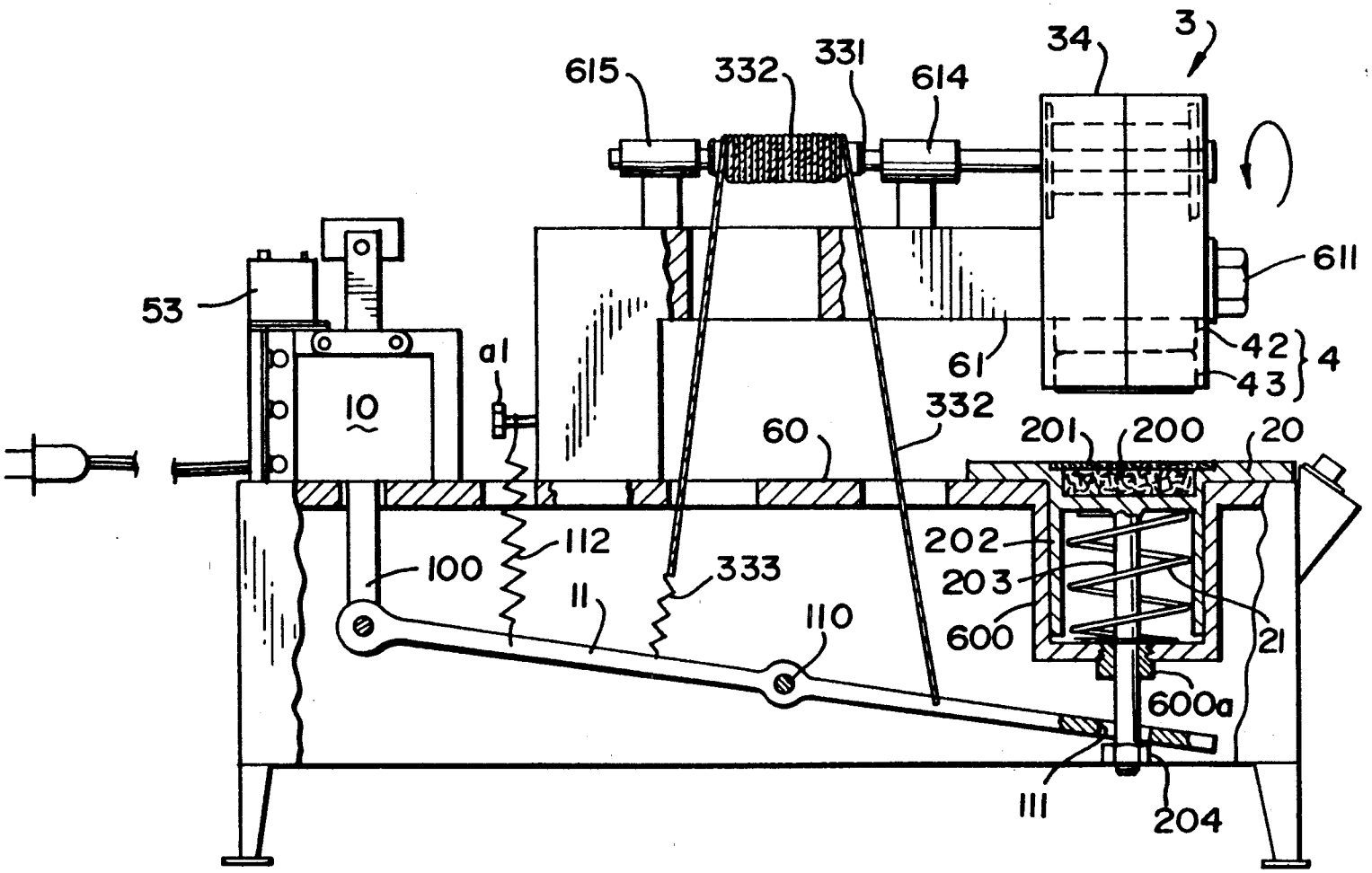
FIG. 3 is a schematic plan view of the preferred embodiment of the present invention, illustrating the operation of the ribbon take-up mechanism during down stroke of the stamp.
Figure 4:
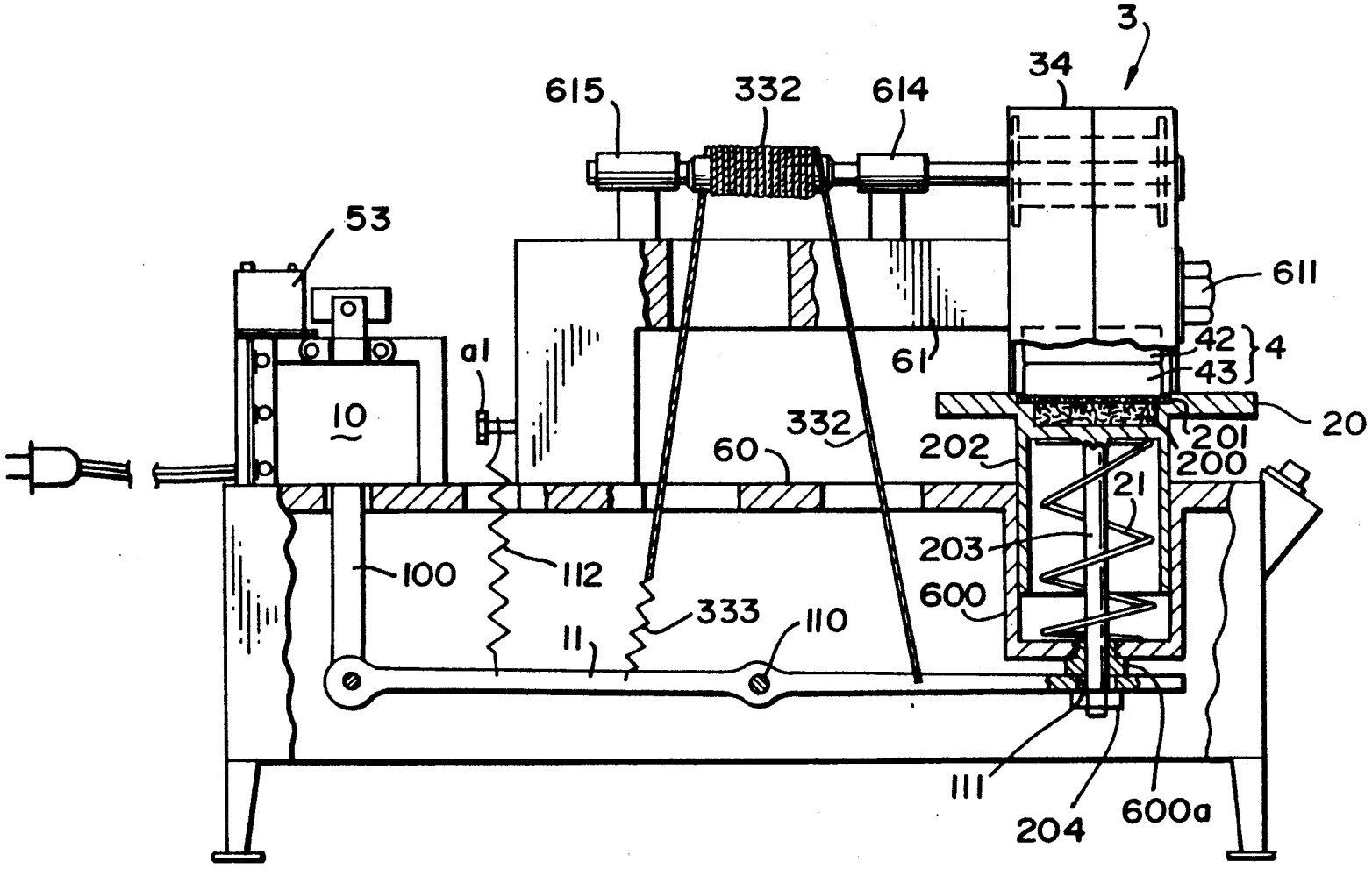
FIG. 4 is another schematic plan view of the preferred embodiment of the present invention, illustrating the operation of the ribbon take-up mechanism during up stroke of the stamp.

The operation of the present invention is outlined hereinafter with reference to FIGS. 2, 3 and 4. As illustrated, the automatic ribbon take-up mechanism 3 is mounted on the front end of the L-shaped support 61 by the opening 340 and the fastening element 611; the stamp 43 is secured to the electromagnet 42 at the bottom by means of magnetic attraction; the ribbon b has one end secured to the ribbon supply reel 31 and an opposite end winding through the two rollers 32 and secured to the ribbon take-up reel 30; the ribbon take-up reel 30 is coupled to the revolving shaft 33 through the chain 330; the revolving shaft is coupled to the rocker arm 11 through the one-way bearing 331 and the rope 332. Therefore, when the main switch 50 is turned on to trigger the starting switch 51, the electronic control system 5 immediately controls the whole machine to operate, permitting the solenoid 10 to drive the rocker arm 11 and the noise deadening device 2 to operate intermittently. Therefore, stamping operation is automatically performed while noise is deadened. During the operation of the rocker arm 11, the revolving shaft 33 is carried by the rope 332 and the one-way bearing 331 to drive the ribbon take-up reel 30 so as to fit the stamping operation of the stamp 43.

I claim:

1. An automatic stamping machine, comprising:

a machine table having a platform at the top for supporting a substantially L-shaped support;

a driving mechanism comprising a solenoid, a reciprocating rod, a spring element and a rocker arm secured beneath said platform by a pivot and driven by said solenoid through said reciprocating rod, said rocker arm having an end connected to said reciprocating rod and confined by said spring element, and having an oppossite end with an elongated hole made thereon;

a noise deadening device comprising a recessed hollow cylinder on said platform, a T-shaped paper rack inserted in said cylinder, and a compression spring disposed in between said T-shaped paper rack and said cylinder, said cylinder having a hole at the bottom and a bolt sleeve disposed in said hole, said T-shaped paper rack comprising a cylindrical body having a top edge made of flexible rubber and covered with a layer of rigid rubber, and a connecting rod vertically extending downward from said top edge and inserted through said bolt sleeve and fixedly secured in said elongated hole of said rocker arm by a lock nut;

an automatic ribbon take-up mechanism comprising a T-shaped ribbon casing having mounted therein a ribbon take-up reel, a ribbon supply reel, two rollers and a revolving shaft, said T-shaped ribbon casing defining an opening at the bottom and mounted on said L-shaped support, a first pair of round holes at an upper position of said T-shaped ribbon casing for mounting said ribbon take-up reel and said ribbon supply reel, and a second pair of round holes at a lower position of said T-shaped ribbon casing for mounting said two rollers, one end of said revolving shaft being inserted through said T-shaped ribbon casing and supported by two bearings mounted on said L-shaped support, the other end of said revolving shaft having a chain to secure said ribbon take-up reel, said revolving shaft having an one-way bearing mounted thereon, said one-way bearing having a rope winding thereon, one end of said rope having an elastic element and connected to said rocker arm at one side relative to said pivot through said elastic element, and an opposite end directly connected to said rocker arm at an opposite side relative to said pivot;

a stamp mounting device comprising a stamp and an electromagnet fastened at a front bottom side of said L-shaped support to attract said stamp in place; and an electronic control system comprising a main switch, a starting switch, an AC/DC converter, a relay and a timer, said main switch controlling the power supply for the machine, said starting switch controlling said AC/DC converter, said relay and said timer to drive said driving mechanism to operate said noise deadening device and said automatic ribbon take-up mechanism to perform stamping operation.

* * * * *